United States Patent [19]

Sprangle et al.

[11] 4,143,299

[45] Mar. 6, 1979

[54] CHARGED-PARTICLE BEAM ACCELERATION IN A CONVERGING WAVEGUIDE

[75] Inventors: Phillip A. Sprangle, Silver Spring, Md.; Adam T. Drobot, Burke, Va.; Wallace M. Manheimer, Silver Spring, Md.

[73] Assignee: The United States of America as represented by the Secretary of the Navy, Washington, D.C.

[21] Appl. No.: 881,463

[22] Filed: Feb. 22, 1978

Related U.S. Application Data

[63] Continuation-in-part of Ser. No. 724,053, Sep. 16, 1976, abandoned.

[51] Int. Cl.[2] ..... H01J 25/10

[52] U.S. Cl. ..... 315/5.41; 313/359; 315/5; 315/5.42; 328/233

[58] Field of Search ..... 328/233; 250/396, 311; 315/3, 4, 5, 5.41, 5.42; 313/361, 359

[56] References Cited

U.S. PATENT DOCUMENTS

| | | | |
|---|---|---|---|
| 3,617,908 | 11/1971 | Greber | 328/233 |
| 3,626,305 | 12/1971 | Furth et al. | 328/233 |
| 3,719,893 | 3/1973 | De Packh | 328/233 |
| 3,720,828 | 3/1973 | Nablo | 250/311 |
| 3,887,832 | 6/1975 | Drummond et al. | 328/233 |
| 3,892,970 | 7/1975 | Freeman et al. | 250/396 |
| 3,916,239 | 10/1975 | Friedlander | 328/233 |
| 4,038,602 | 7/1977 | Friedman | 328/233 |
| 4,070,595 | 1/1978 | Miller | 328/233 |

*Primary Examiner*—Saxfield Chatmon, Jr.
*Attorney, Agent, or Firm*—R. S. Sciascia; Philip Schneider

[57] ABSTRACT

An electron beam and collective ion-electron beam accelerating apparatus in which a relativistic electron beam and ions moving with it are accelerated in speed by passing them through a converging waveguide (i.e., a drift tube) of gradually decreasing diameter. The ions are separated from the electrons upon leaving the waveguide.

21 Claims, 3 Drawing Figures

CHARGED-PARTICLE BEAM ACCELERATION IN A CONVERGING WAVEGUIDE

This application is a CIP of Ser. No. 724,053, filed Sept. 16, 1976, now abandoned.

BACKGROUND OF THE INVENTION

This invention relates to the acceleration of charged-particle beam and especially to the acceleration of high-current ion electron beams to higher velocities.

Conventional ion accelerators of either the linear or cyclotron type suffer from several disadvantages.

1. Being passive devices, the maximum accelerating fields they produce are limited.

2. To achieve relativistic ion energies, the conventional accelerators, because their maximum accelerating fields are limited, require either great length for linear devices or large radius for cyclotrons.

3. The currents must be small because the devices are inherently phase-unstable.

Of the proposed non-conventional accelerators using active media, there are two types.

1. The collective accelerator, such as the electron ring (ERA) or the moving electron well. The disadvantages of these is that they suffer from both instabilities and inertial effects.

2. The collective resonant accelerator, such as the autoresonant accelerator (ARA) which seeks to use an eigenmode of the active medium. This combines the best features of collective and conventional accelerators. The ARA suffers from the disadvantage of requiring a high-magnetic-field structure which is cumbersome and expensive and of producing an uncollimated beam at its output end.

The present invention is eonomical and compact compared to conventional accelerators. It can produce a high ion-beam current, the output beam being collimated. There is no need for a high magnetic field, and the efficiency of the device is relatively high.

SUMMARY OF THE INVENTION

The present invention comprises a waveguide device which accelerates to higher velocities an electron beam and ions which are being moved along with the electrons by a space charge wave propagating on the electron beam. The ions are moving with an electron beam which is density-modulated, the particles (ions and electrons) being accelerated by propagation through a converging waveguide. After the particles attain the desired higher velocities, the electrons are bent out of the beam axis leaving only the heavier ions to proceed along the waveguide axis.

DETAILED DESCRIPTION OF THE INVENTION

Figure 1:
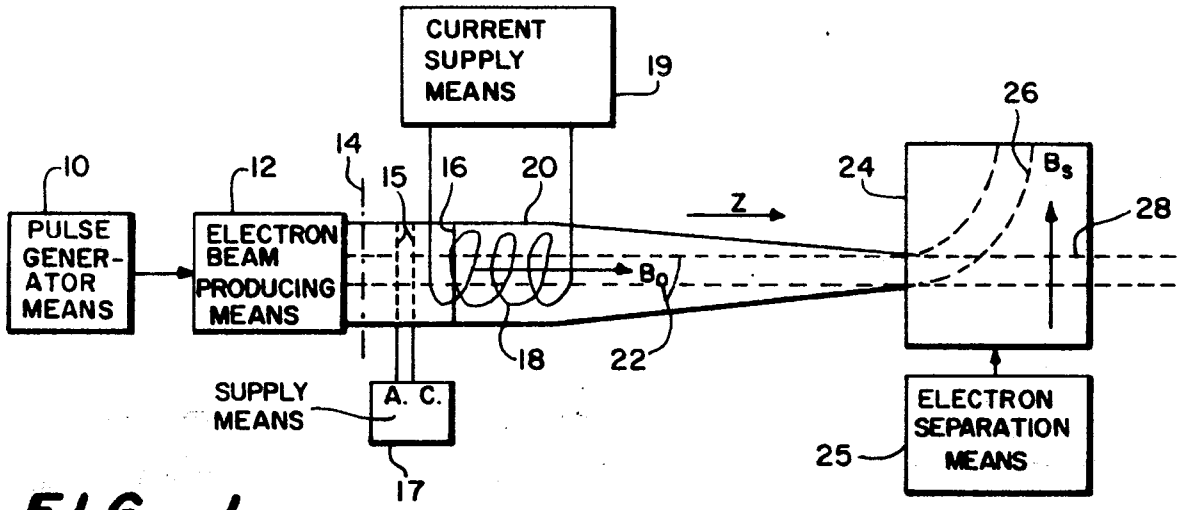
FIG. 1 is a schematic representation of an embodiment of the space-charge-mode version of the present invention.

An embodiment of the invention which operates in the space-charge mode is shown in FIG. 1. Pulse generator means 10 is used to pulse an electron-beam-producing means 12, such as a field emission diode, which is coupled to a waveguide, or drift tube, 20 of radius (r). The pulsing means 10 is required when a field emission diode is employed but it should be noted that it may not be required when other types of electron emission means are used.

The waveguide 20, which is also known as a drift tube, or drift region, is formed from an electrically conducting material, such as copper, and its longitudinal direction Z is indicated by an arrow marked in the figure. The radius of the waveguide is a function of Z (after an initial length in which the radius is constant). Its initial diameter is greater than the effective diameter of the electron-emitting portion of the electron-beam-producing means 12, so that the velocity of the electrons entering the waveguide is slowed down to a fraction of the speed of light (The region where the velocity is minimum is somewhat past the entrance to the waveguide and is schematically indicated by the line 14 in FIGS. 1 and 2). A physical explanation of the slowing down of the beam is the following:

The total energy of the beam is that due to the kinetic energy (functionally proportional to velocity) of the electrons plus the energy in the electromagnetic field of the moving electrons. When the field expands, as it does when the electron beam enters the wider space of the waveguide, or drift tube, more energy is required to maintain the field. This energy is taken from the kinetic energy of the moving electrons; hence, the electrons slow down. On the other hand, when the field contracts, as it does in the converging drift tube, field energy reverts to the beam to provide the electrons with more kinetic energy and the beam velocity accelerates. The minimum speed to which the electron beam should be slowed is no less than a speed slightly above that at which the beam would disrupt due to its internal repulsive forces. This slightly-above-minimum speed would be a relativistic speed, roughly in the vicinity of one-half the speed of light. The aim of the procedure is to slow down the electron beam to a speed at which the negative-energy space charge wave to be propagated in the beam efficiently collects the ions and carries them along but not slow enough to allow disruption of the beam. The ions are carried, or moved along, by the space charge wave (negative-energy wave) in the electron beam. The ions are moved along at the speed of the wave which moves more slowly than the electrons. At the time of injection the ions may be moving at, perhaps, a tenth of the speed of light and, since the space charge wave should be moving at about the same speed to pick up the ions efficiently, the electron beam must be slowed down. This is because the negative-energy wave must travel at a smaller velocity than the electrons.

The slowing down of the electron beam by an increase in diameter of the walls of a waveguide through which the beam is propagating was shown experimentally by M. Friedman in his paper "Formation of a Virtual Cathode by a Relativistic Electron Beam Flowing Through a Cavity", Applied Physics Letters, Vol. 24, No. 7, Apr. 1, 1974. Equations for this situation were given in a review paper written by Brejzman and Ryutov, entitled "Powerful Relativistic Electron Beams in a Plasma and in a Vacuum (Theory)", Nuclear Fusion, Vol. 14, Pg. 873, 1974. In section 2 which deals with electron beam transport in a vacuum in a longitudinal magnetic field, the authors provide the following equations:

$$\phi(v) = 2\frac{I_b}{v}\begin{cases}\ln\frac{R}{v}, & v_b < v < R\\ \ln\frac{R}{v_b}, & v \leqq v_b\end{cases} \quad 2.1$$

$$v = c\left\{1 - \left(\gamma_o + \frac{e\phi_b}{mc^2}\right)^{-2}\right\}^{\frac{1}{2}} \quad 2.2$$

where $v$ is the electron velocity, m is the electron mass, e is the electron charge, c is the speed of light, $\gamma_o$ is the electron energy at the input to the drift space, $I_b$ is the total current, r is the radial distance from the center of the drift tube, $r_b$ is the radial distance from the center of the drift tube to the inner surface of the electron beam, R is the radius of the drift tube and $\phi_b$ is the electrostatic potential at $r_b$.

From eq. 2.1, it can be seen that $\phi_b$ is negative and its absolute value varies as a function of the drift tube radius R, i.e., the larger R is, the greater the absolute value of $\phi$.

Writing eq. 2.2 in a slightly different form $$v = c\left\{1 - \frac{1}{\sqrt{\gamma_o - \frac{e|\phi_b|}{mc^2}}}\right\}^{\frac{1}{2}} \quad 2.3$$

it can be seen that an increase in R, the drift tube radius, increases $|\phi_b|$, decreases the number inside the square root sign, increases the value of the inverse of the number inside the square root sign, decreases the value of the bracketed number and thus decreases the electron velocity, $v$. This applies to the point at which the electron beam from the electron-beam-producing means 12 enters the larger diameter of the waveguide 20.

Conversely, as the waveguide transverse area decreases, the velocity of the beam will speed up.

The slowly moving electrons are then bunched, (i.e., density waves of the negative-energy type are formed), for example, by passing them through a pair of grids 15 to which an alternating voltage is applied by an a.c. supply means 17.

Ions are then incorporated into the slowly moving beam in any convenient manner. For example, the beam can be propagated through a nylon (polyamide) sheet 16, the beam knocking out ions on its way through the sheet. Other ways of introducing ions include direct injection of ions, for example, hydrogen gas ions, into the cavity. The beam is now a slowly moving beam including bunched electrons and ions. The beam in the waveguide is indicated generally by the dashed lines numbered 22, the dashed lines showing the approximate outer limits of the beam. The formation of a collective ion-electron beam by another method is taught in U.S. Pat. No. 3,887,832, issued June 3, 1975 to Drummond et al.

It should be noted that the ions can be introduced shortly after or before the negative-energy wave is initiated; the timing is not critical.

The waveguide radius, r, which is initially greater than the radius of the beam, $r_b$, and remains constant until after the bunched beam containing the ions is formed, is now gradually decreased, i.e., the waveguide is gradually tapered, or converged, or the cross-sectional area, taken transversely to the direction of beam propagation, is gradually decreased. This increases the beam and the space charge wave velocities, the object being to accelerate the beam particles to higher relativistic velocities without losing the heavy ions. The rate of convergence of the waveguide must not be so great that the rate of increase of the space charge velocity is too great to carry the ions with it, thereby losing the ions.

Magnetic-field-producing means, which may comprise a coil 18 and current supply means 19, establishes a longitudinal magnetic field, $B_o$, in the waveguide as indicated by the direction arrow marked $B_o$. This field is solely for the purpose of keeping the beam from dispersing in the radial direction. Thus, the B field intensity does not have to be of a high order of magnitude.

The use of magnetic fields in waveguides which are called drift tubes is shown, for example, in the following:

M. Friedman, "Unstable Flow of a Magnetically Focused Unneutralized Relativistic Electron Beam", Physical Review Letters, Vol. 35, No. 9, Sept. 1, 1975, Pg. 572. (e.g., See FIG. 1 showing a waveguide surrounded by a solenoid. The article designates the waveguide as a "drift tube.")

Read and Nation, "Space Charge Limits in Unneutralized Relativistic Electron Beams," J. Plasma Physics (Great Britain) 1975, Vol. 13, part 1, pp. 127–137. (e.g., FIG. 1 shows a waveguide surrounded by magnetic field coils. The waveguide is called a drift tube.)

Miller and Straw, "Propagation of an unneutralized intense relativistic electron beam in a magnetic field," J. of Applied Physics, Vol. 48, No. 3, 1977, pp. 1061–1069. (e.g., See FIG. 1 showing a waveguide surrounded by magnetic field coils and pg. 1063, col. 1, line 29, where the waveguide is called the "drift tube.")

After the beam 22 is brought up to the desired relativistic speed, the electrons are separated from the ions in a chamber 24. The means for separating the electrons from the ions, shown generally by box 25, may be another coil and current supply for providing a magnetic field $B_s$ in chamber 24. The $B_s$ field bends the electrons into a beam 26 at an angle, preferably transverse, to the ion beam 28 which, being much heavier, keeps travelling in the original direction. The final result is a collimated ion beam 28, travelling at a relativistic velocity, which can be utilized as desired.

It is important to note that the beam as it travels down the drift tube can be made to reaccelerate by the convergence, or tapering, to its initial velocity, v, and energy $\gamma MC^2$ merely by decreasing the radius $r_g(Z)$ of the drift tube [$\gamma=(1-\beta^2)^{-\frac{1}{2}}$, $\beta=(V/C)$, V = the beam velocity, c = the speed of light, and m = the mass of an electron].

Close to the diode 12, a negative-energy wave is induced and ions are trapped within it. There are two possible negative-energy modes in this system:

(a) The doppler-shifted space-charge mode;

(b) The doppler-shifted lower cyclotron mode (also known as the slow space charge mode).

Figure 2:
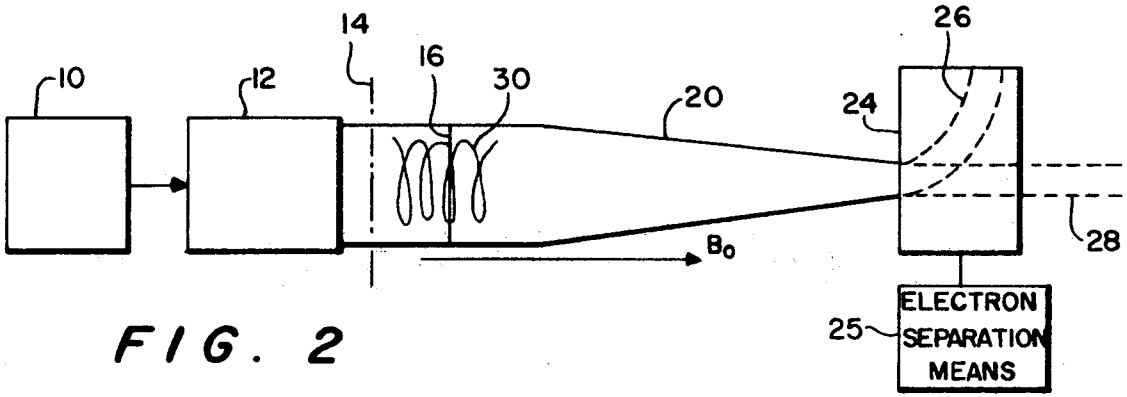
FIG. 2 is a schematic representation of an embodiment of the lower-cylotron-mode version of the present invention.

The convergence of the drift tube can be used to regulate the phase velocity of either mode, a gradual change in the radius $r_g(Z)$ of the drift tube being used to accelerate the low velocity of the ions at the outset to a phase velocity $\simeq c$ at the end of the drift tube. Thus, the ions in either mode can be made to achieve high relativistic velocities. An embodiment for utilizing the lower cyclotron mode is shown in FIG. 2.

The apparatus is the same as than shown in FIG. 1 except that a different density-wave-forming means 30 is shown. Instead of the a.c. voltage supply and grids shown in FIG. 1, a single coil, or helix, 30 of electrically conductive material can produce bunching in the beam. (Periodically loaded waveguide devices, such as travelling wave tubes, can also be used as density-wave-forming means.)

The magnetic field strength, $B_o$, in this case must be considerably greater than in the space-charge mode to cause the beam to spiral around the Z (longitudinal) axis of the drift tube. (For clarity, the means for producing the magnetic field is omitted from this figure.) Actually, a high B field is required only at the left end of the tube; the B field can be reduced or stepped down as the beam progresses down the drift tube. An advantage of using the cyclotron mode is that the density waves in this mode are slowed down more easily which means that the ions can be picked up by the electron beam more easily. However, a disadvantage is that the B field must, at least initially, be greater. For the space-charge mode, the B field might be on the order of 20 kilogauss, whereas for the lower cyclotron mode, the B field might be on the order of 40–50 kilogauss.

What has been disclosed herein is a new, collective-beam, ion-acceleration scheme which utilizes a negative-energy space-charge wave in a slowed relativistic electron beam to capture and accelerate ions to higher, relativistic velocities. The principle of operation is based on the fact that the phase velocity of a negative-energy space-charge wave can be increased from velocities much less than c to approximately c, simply by propagating an electron beam through a converging waveguide. By initiating a low-phase-velocity, negative-energy wave in the presence of ions, energy can be supplied to the field at the expense of the energy in the electron beam. Hence, ions can be trapped in both an accelerating and growing longitudinal electric field.

The final velocity of the ions is equal to the final phase velocity of the wave which in turn is approximately the final velocity of the relativistic electron beam. Preliminary estimates indicate that the conversion efficiency of electron-beam to ion-beam energy may be as high as 30%; therefore, as an example, ion beams of 50A at 1 GeV may be attainable using a modest electron beam source at 5 MeV and 30 kA.

Figure 3:
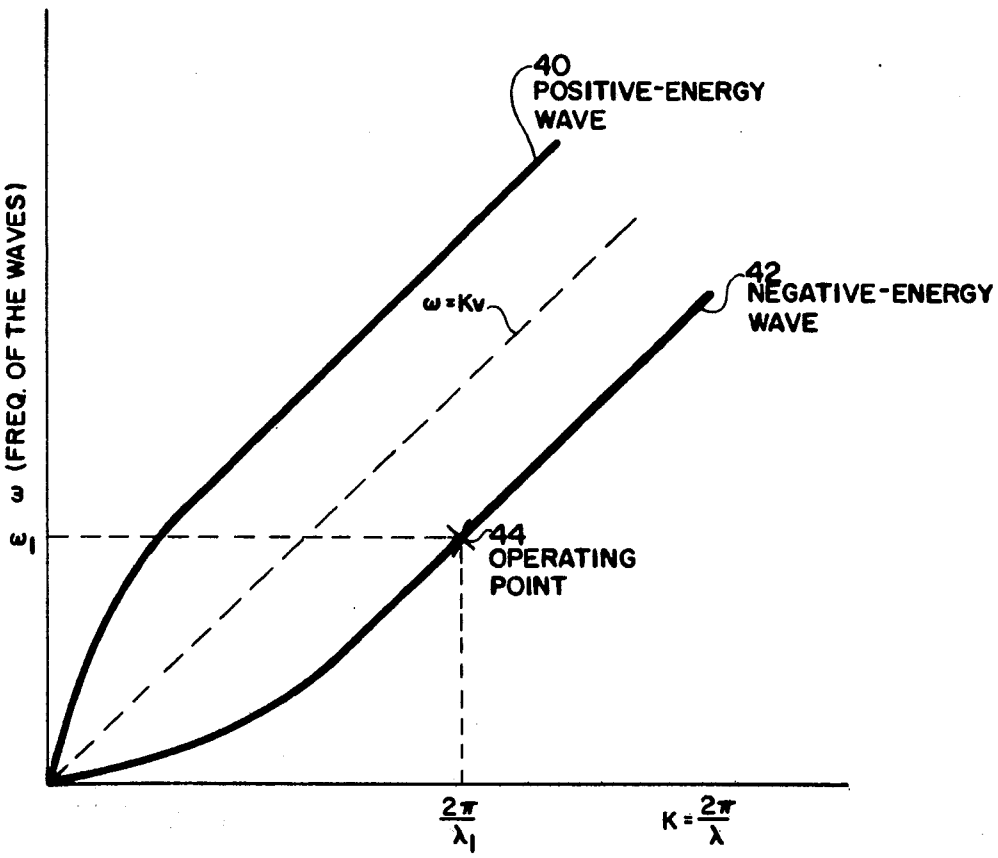
FIG. 3 is a curve, known as a dispersion diagram, of negative- and positive-energy waves in an electron beam in a waveguide.

FIG. 3 shows a plot of frequency ($\omega$) vs wave number (k) for positive and negative-energy waves in an electron beam in a drift tube. Such waves are discussed by Krall and Trivilpiece, "Principles of Plasma Physics", McGraw-Hill, 1973, Chap. 4 (Waves in the Fluid Plasma), for example. FIG. 4.3.1 therein is a dispersion diagram similar to FIG. 3 herein, except that FIG. 3 is applicable to an actual piece of apparatus in which the waves are three-dimensional instead of one-dimensional. The discussion in Chap. 4 shows that perturbations, such as produced by closely spaced grids across which a sinusoidal voltage is applied, will produce positive-and negative-energy waves (see especially, section 4.3.2, Positive and Negative Energy Waves in a Drifting Plasma).

In FIG. 3 herein $\omega$ is the frequency of the waves, K is the wave number, $\lambda$ is the wavelength. It is obvious from this figure that, if the operating point 44 is selected on the negative-energy wave 42, formation of a large-amplitude negative-energy wave is encouraged while formation of a positive-energy wave 40 is discouraged, although a small-amplitude positive-energy wave may still be present. (However, even if positive- and negative-energy waves of equal amplitude are present, the acceleration process in the drift tube is not affected.) Selection of an operating point determines a wavelength $\lambda_1$, and the spacing between the grids 15 is made approximately equal to ($\lambda_1/4$). The operating point also determines the frequency of the negative-energy wave which is determinative of the frequency of the sinusoidal voltage which is applied to the grids 15 to provide the density modulation of the electron beam. (The theory of the bunching, or density modulation, of an electron beam is also discussed, for example, in Chap. 3 of Beck, "Velocity Modulated Thermionic Tubes", especially sections 3.2 and 3.3).

It should be noted that apparatus for producing an electron beam in which ions are also present, i.e., a collective ion-electron beam, is known and is not part of the present invention which comprises a waveguide which decreases in cross-sectional area and accelerates the collective beam.

The ions are injected into a slowly converging guide, in the presence of a uniform magnetic field, $B_o$, as shown in FIG. 1. The beam will propagate provided certain injection and stability conditions are satisified.

The injection criterion, which assures that the electron beam will slow down enought to become unstable but will propagate upon entering the guide, is $$\gamma inj - 1 > (\omega_b r_b/2c)^2(1 + 2 \ln r_g/r_b), \quad (1)$$

where $\omega_b = (4\pi|e|^2 n_e/m_e)^{\frac{1}{2}}$, ne is the beam density in the laboratory frame, $m_e$ is the electron rest mass, $r_b$ is the beam radius, $r_g$ is the guide radius and $(\gamma inj - 1)m_e c^2$ is the injection energy. The stability condition is $$\frac{\omega_b^2 r_g}{\Omega_o c} < \gamma e, \quad (2)$$

where $\Omega_o = |e|B_o/m_e c$ *and* $\gamma_e = (1 - v_e^2/c^2)^{-\frac{1}{2}}$. Strong fulfillment of (2) leads automatically to the fulfillment of the equilibrium conditions on the beam.

In steady-state operation, the combined field and particle energy flux through successive cross-sections of the guide is conserved. Propagation of a beam through a converging guide accelerates the beam. Assuming conditions (1) and (2) are satisfied and that the convergence of the guide is slow, conservation of total energy flux yields.

$$\gamma_e(z) = \gamma_e(O) + \frac{\omega_b^2(O)}{4}\left[\frac{r_b^2}{c^2}\, 1 + 2 \ln r_g(O)/r_b - (v_e(O)/v_e(z))\,(1 + 2 \ln r_g(z)/r_b)\right], \quad (3)$$

where the arguments of the quantities refer to their values at the axial position, z. In obtaining (3), it has been assumed that the radius of the beam is held fixed by the guide magnetic field, $B_o$, and the beam velocity is independent of radial position. From Eq. (3), it is easily seen that for a suitable choice of parameters it is possible to have $\gamma(L) > \gamma(O)$. However, $\gamma_e(L)$ can not be greater than the injection value, $\gamma_{inj}$. Given the initial beam current and energy, Eq. (3) has two physically acceptable solutions for $\gamma_e(z)$. Equation (3) also implies that a minimum $\gamma$ exists, $\gamma_{min}>1$. In this analysis the $\gamma(z)\geqq\gamma_{min}$ branch of Eq. (3) is used.

It should be noted that the converging waveguide will accelerate the electrons alone if no space-charge wave is imposed on the electron beam, and will accelerate the space-charge wave if such a wave is imposed on the beam. Of course, ions which are trapped in the potential wells produced in the electron beam by the space-charge wave are also accelerated.

Obviously many modifications and variations of the present invention are possible in light of the above teachings. It is therefore to be understood that within the scope of the appended claims the invention may be practiced otherwise than as specifically described.

What is claimed and desired to be secured by letters patent of the United States is:

1. In an apparatus for producing a relativistic collective ion-electron particle beam having a negative energy space-charge propagating therealong in the direction of flow of the beam, means for accelerating the particles comprising a waveguide through which said beam is propagated, said waveguide having a gradually decreasing cross-sectional area taken transversely to the direction of propagation of the beam.

2. Beam acceleration means as in claim 1, including magnetic field-producing means for providing a longitudinal magnetic field in said waveguide for preventing radial dispersion of said beam.

3. Particle acceleration means as in claim 2, further including means for propagating a negative-energy space-charge wave along said beam in the direction of flow thereof, and wherein the rate at which the cross-sectional area of the waveguide decreases is sufficiently slow that the ions are accelerated substantially in unison with the space charge wave in the beam.

4. Particle acceleration means as in claim 2, including means for extracting the electrons from said collective beam at the high-speed end of the waveguide, so that the remaining beam comprises only a beam of ions moving at relativistic speeds.

5. A method for accelerating a relativistic electron beam comprising the step of:

propagating said beam within and in the direction of the longitudinal axis of a waveguide which has in the direction of beam propagation, a gradually decreasing cross-sectional area transverse to its longitudinal axis.

6. The method of claim 5, including the step of applying a magnetic field to said beam in the direction of the beam to minimize radial dispersion of the beam.

7. A method for accelerating a collective relativistic ion-electron beam propagating within and in the direction of the longitudinal axis of a waveguide, the ions in said collective beam being carried along by a negative-energy space-charge wave in the electron beam, comprising the step of:

gradually decreasing, in the direction of beam propagation, the cross-sectional area of the waveguide transverse to its longitudinal axis.

8. The method of claim 7, including the step of:

applying a magnetic field to said beam in the direction of the beam to minimize radial dispersion of the beam.

9. Particle acceleration means for use with apparatus for producing a relativistic electron beam comprising:

a longitudinal waveguide into and along whose longitudinal axis said beam is injected and propagated, said waveguide being gradually tapered in the direction of propagation of said electron beam.

10. Particle acceleration means as in claim 9, including:

magnetic field-producing means for providing a longitudinal magnetic field in said waveguide for preventing radial dispersion of said beam.

11. Particle acceleration means as in claim 9, further including:

means for propagating a negative-energy space-charge wave along said beam in the direction of its flow;

means for slowing the velocity of said beam; and means for introducing ions into said beam at a velocity comparable to that of said slower beam so that the ions will be carried along thereby.

12. Means for accelerating a relativistic particle beam formed, at least, of electrons comprising:

a waveguide through which said beam is propagated, said waveguide having a gradual taper in the direction of propagation of the beam.

13. Beam acceleration means as in claim 12, including magnetic-field-producing means for providing a longitudinal magnetic field in said waveguide to minimize radial dispersion of the beam.

14. Beam acceleration means as in claim 12, including means for inducing a negative-energy space-charge wave on the electrons in said beam.

15. Beam acceleration means as in claim 14, wherein said particle beam includes ions as well as electrons.

16. In a means for producing a combined ion and electron beam having a negative-energy space-charge wave propagating along said beam in the direction of flow of the beam, means for accelerating the ions in said beam comprising a tapered waveguide through which said beam is propagated, said waveguide having a gradual taper in the direction of propagation of said beam.

17. Acceleration means as in claim 16, further including magnetic-field-producing means for providing a magnetic field in said waveguide such as to minimize radial dispersion of the beam.

18. In a means for producing a combined ion and electron beam having a negative-energy space-charge wave propagating along said beam in the direction of flow of said beam, said ions being trapped and carried along by said space-charge wave, means for accelerating said space-charge wave comprising a tapered waveguide through which said beam is propagated, said waveguide having a gradually decreasing cross-sectional area in the direction of propagation of said beam.

19. Acceleration means as in claim 18, further including magnetic-field-producing means for providing a magnetic field in said waveguide such as to minimize radial dispersion of said beam.

20. An accelerating means in claim 12, wherein said relativistic particle beam resonates in the lower cyclotron waveguide mode.

21. An accelerating means as in claim 20, including means for causing said electron beam to resonate in the lower cyclotron waveguide mode.

* * * * *